United States Patent [19]

Thym et al.

[11] 3,983,889

[45] Oct. 5, 1976

[54] PROCESS FOR CLEANING THE SURFACE OF CONTINUOUSLY CAST STRIP

[75] Inventors: Günter Thym, Greifensee, Switzerland; Oswald Kaiser, Lintorf; Heinz Jürgen Althoff, Kirchhellen, both of Germany

[73] Assignee: Leichtmetall-Gesellschaft mbH, Essen-Borbeck, Germany

[22] Filed: May 20, 1975

[21] Appl. No.: 579,262

[30] Foreign Application Priority Data

May 20, 1974 Switzerland ..... 6871/74

[52] U.S. Cl. ..... 134/9; 134/15; 134/34; 164/87

[51] Int. Cl.[2] ..... B08B 3/02

[58] Field of Search ..... 134/9, 15, 34, 39; 164/73, 87, 89, 121, 123, 158, 69, 128

[56] References Cited

UNITED STATES PATENTS

| | | | |
|---|---|---|---|
| 2,158,694 | 5/1939 | Fenton | 134/9 |
| 3,076,241 | 2/1963 | Simonson et al. | 164/73 |
| 3,795,269 | 3/1974 | Leconte et al. | 164/87 |
| 3,848,804 | 11/1974 | Prestwich | 134/34 X |

*Primary Examiner*—S. Leon Bashore
*Assistant Examiner*—Richard V. Fisher
*Attorney, Agent, or Firm*—Ernest F. Marmorek

[57] ABSTRACT

The invention concerns a process for cleaning the surface of cast strip produced on continuous casting machines, and concerns in particular strip of aluminium, zinc or their alloys. The cast strip is formed between two endless strip molds which are spaced apart and are provided at least in part with a protective layer in the form of a particulate material. Particles of the protective layer adhering to the cast strip are removed from the strip by spraying with water under pressure immediately after the strip solidifies, on leaving the mold.

7 Claims, 3 Drawing Figures

PROCESS FOR CLEANING THE SURFACE OF CONTINUOUSLY CAST STRIP

The invention concerns a process for cleaning the surface of strip produced on continuous casting machines in particular for strip of aluminium, zinc or their alloys, whereby the cast strips are formed between two moving endless strip molds which are spaced apart and are at least in part provided with a protective layer which is in the form of a particulate material.

Casting machines which operate with two continuous strip molds are also called strip casting machines. By means of such equipment so-called cast strips are produced for further reduction by rolling. The advantage of these cast strips is that several other stages of the conventional method of strip production such as ingot casting, cutting, re-heating and hot rolling are omitted.

In the case of the strip casting machines discussed here, basically two designs in construction are explored in which, in one case the continuous strip molds are made up on individual units of a caterpillar track and in the other case smooth continuous steel strips are used.

Problems arise with equipment of this kind, in particular in connection with the thermal loading of the strip molds. The thin steel strips tend to stretch due to thermal expansion, which leads in turn to a twisting of the thin mold strips. The twisting of the strips disturbs the heat flow through the strip i.e. the cooling, which leads to serious problems in the cast strip. To counteract this the strip molds are provided with an insulating covering which prevents the temperature of the strips from rising above 200° – 300°C, when liquid aluminium is introduced between the strips. Caterpillar track molds on the other hand because of their design do not give rise to the problem of twisting, but are still provided with a coating to control the heat conduction in order to meet certain metallurgical requirements.

The known coatings, whether to provide insulation or to control heat conduction, consist of a binder containing solid particulate material. A typical mixture is made up of carbon for lubrication and uniform heat conduction, kieselguhr for insulation and polyvinylpyrrolidon (PVP) for binding the solid powders or particles together. Since this binder decomposes at the temperature of the liquid metal, the solid particles or components of the coating material are transferred to the cast strip. The objective in strip casting is to roll down the strip directly after casting, making use of as much as possible of the heat residing in the strip. If now a particle of only 0.1 mm in diameter is present on a 20 mm thick cast strip, then the particle or at least its impression will be extended to a much larger extent by further processing e.g. rolling. On producing a thin aluminium foil with a final thickness of 5 $\mu$m there will be for example a fault in the foil, 0.1 mm wide and 4000 mm long. Such particles can also not be tolerated in the production of thicker strip and sheet which are to be used for high quality products.

The object of the invention presented here is to provide a process for cleaning the surface of continuously cast strips, in which after the cast strips leave the strip molds just after it has solidified, the surface of the strip formed by the strip molds is impacted by a water stream under pressure. It is important that the cleaning of the strip is undertaken immediately after the strip leaves the casting machine, immediately after the strip has solidified, so that the particles from the coating are not burnt in to the surface of the cast strip and are not rolled in to the skin of the strip by the support rolls or feed rolls between the casting machine and the rolling mill.

Usefully a water stream of 200 to 1000 liters per minute at a pressure of 2 – 300 atm, preferably 3 – 8 atm, can be jetted onto each side of a cast strip of up to 2000 mm in width and 10–35 mm thick. Since the rolling after casting should make use of as much of the residual heat in the strip as possible, the heat loss in the washing process should be kept to a minimum. The cleaning effect is indeed somewhat smaller at lower pressure, the cooling of the strip can, however, by this means, be kept to a minimum; at a high water pressure, on the other hand, the cleaning effect is excellent, but leads to a considerable cooling of the strip. At a water pressure of 5 atm and the given quantity of water per unit of time, an aluminium strip e.g. 1500 mm wide and 20 mm thick, leaving the casting machine at 560°C, cools by 60° – 80°C in the washing unit immediately following the casting machine. With all other parameters being the same, a water pressure of 200 atm produces a 300°C drop in temperature of the strip. Water pressures of up to 300 atm can be used, if higher forces can be tolerated. Optimum results with respect to cleaning and strip cooling, in particular for aluminium and its alloys, are achieved with a water pressure of 3 – 8 atm.

The cleaning effect is improved, if the stream of water directed onto the strip is divided up into several uniform jets of equal intensity. These jets can be arranged side by side perpendicular to the direction of movement of the strip, usefully also displaced behind and beside each other. It has also been found that an exceptionally good washing effect is produced, when one or more adjacent water jets are/is moved across the surface of the moving cast strip.

Usefully, mechanical cleaning e.g. by brushing, can be carried out after washing. It is advantageous to install a second water cleaning unit to remove the particles freed from the cast strip by brushing.

Figure 1:
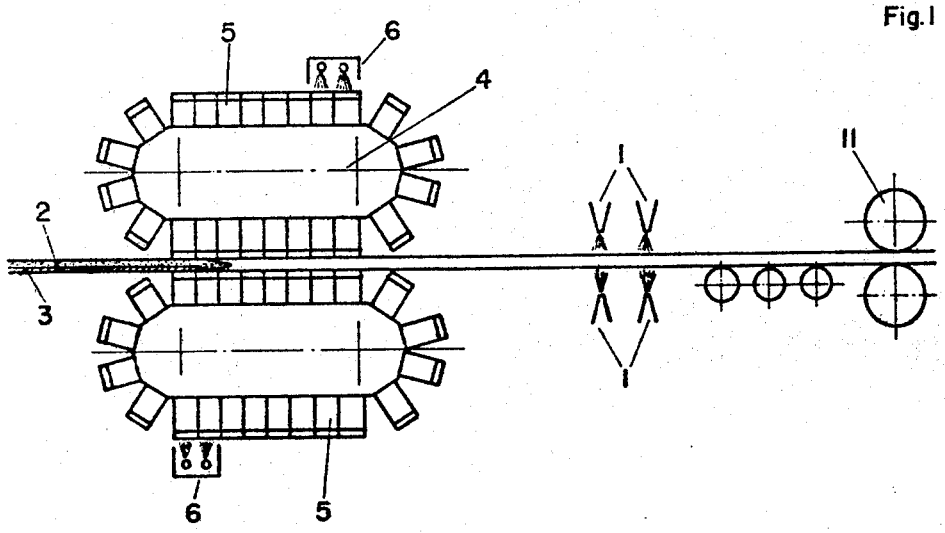
FIG. 1 is a schematic side view of a spray device following on from a casting machine with caterpillar track molds.

For low water pressures what has been found to work well is a spray device 1 of the kind shown schematically in side view in FIG. 1 following on from a casting machine 4 with caterpillar track molds 5. Liquid metal e.g. aluminium is fed by means of a suitable melt feed system 3 into the casting machine. The liquid metal gives up its heat to the caterpillar track molds and solidifies. The mold strips are cooled by spraying with water as they return to the end where the liquid metal is fed in. After the cooling stage 6, a thin layer of insulating material is sprayed on to the caterpillar track strips. Solid particles from this insulating layer are transferred to the surface of the aluminium strip when this layer comes in contact with the liquid aluminium. The layer is relatively thin, so that low pressures are adequate for washing the strip surface.

Figure 2:
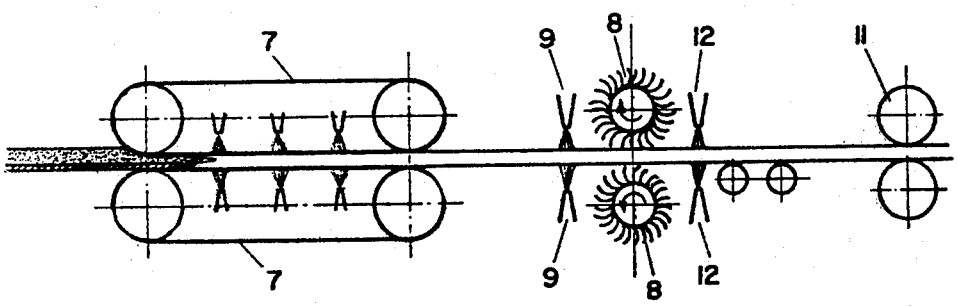
FIG. 2 is a schematic side view of spray devices and a mechanical cleaner following a continuous strip mold.

In the casting machine with continuous steel strip mold 7, shown in FIG. 2, there are deposited thicker layers which have to provide not only control of heat conduction but also thermal insulation. Inevitably a large number of particles, mainly of large dimensions, remain on the cast strip. Low pressures ensure extensive removal of such particles; additional cleaning can be carried out by the brushes 8, after which to ensure complete removal of particles another water jetting unit 12 can be provided. If there is no brushing operation included the use of higher water pressures, up to the given levels has proved to be adequate for the removal of such particles. The result of this is an undesireable loss of heat from the strip, which can however be compensated for by providing a means of heating the strip in front of the first rolling mill.

Figure 3:
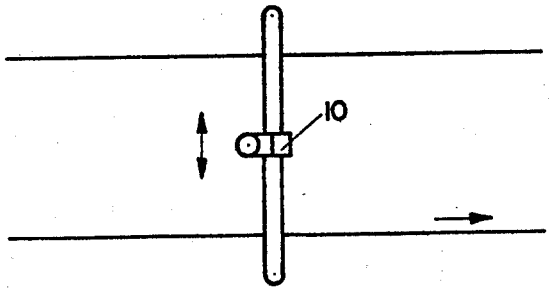
FIG. 3 shows the arrangement of a spray nozzle moving over a cast strip.

FIG. 3 shows the arrangement of a spray nozzle which moves across the strips perpendicular to the direction in which the strip moves. Although only one nozzle is shown here, several nozzles can be provided side by side and displaced behind each other and can be controlled simultaneously for example by means of a moveable beam. The nozzle or several nozzles 10, after crossing the width of the strip, reverse their direction of movement and cross the strip again in the reverse direction. The casting speed and the movement of the water spray device are so adjusted that each position on the cast strip is sprayed by one or more water jets.

What we claim is:

1. A process for cleaning the surface of a cast strip composed of a metal selected from the group consisting of aluminum, zinc, and alloys thereof and manufactured between two spaced apart continuous strip molds each having at least a portion of a protective layer comprising particulate material, said process comprising the step of:

spraying said cast strip with water under pressure immediately after said cast strip solidifies after it is removed from said casting molds, said cast strip having a width up to 2000 mm and a thickness between 10 to 35 mm and said spraying being carried out with a jet stream of water delivered at the rate of 200 to 1000 liters per minute at a pressure of 2 to 300 atm, whereby particulate matter adhering to said cast strip is removed therefrom.

2. A process as claimed in claim 1, wherein the pressure is between 3 and 8 atm.

3. The process as claimed in claim 1, wherein the spraying is carried out with a plurality of jet streams.

4. The process as claimed in claim 1, wherein the spraying is carried out with a plurality of jet streams oriented perpendicular to the plane of said cast strip.

5. The process as claimed in claim 1, wherein the spraying is carried out with a plurality of jet streams and further comprising the step of moving the jet streams across the surface of said cast strip.

6. The process as claimed in claim 1, further comprising the step of mechanically cleaning the surface of said cast strip after said spraying step and thereafter applying another spray of water under pressure, whereby particles freed by said mechanical cleaning are removed from said surface.

7. The process as claimed in claim 1, wherein said cast strip has a width of about 1500 mm.

* * * * *